United States Patent [19]

Olson

[11] Patent Number: 4,879,786

[45] Date of Patent: Nov. 14, 1989

[54] LOW PROFILE TILT LOCK MECHANISM WITH PIVOTABLE LOCKING LINK TO ENGAGE CAM SURFACE

[75] Inventor: Robert N. Olson, Sunnyvale, Calif.

[73] Assignee: Ampex Corporation, Redwood City, Calif.

[21] Appl. No.: 179,150

[22] Filed: Apr. 8, 1988

[51] Int. Cl.[4] ..... E05C 17/64; E05D 11/08

[52] U.S. Cl. ..... 16/341; 16/345; 16/347; 16/349; 16/DIG. 42

[58] Field of Search ..... 16/327, 328, 333, 341, 16/345, 347, 349, DIG. 42; 292/219, 228, 229, 278, 304

[56] References Cited

U.S. PATENT DOCUMENTS

| | | | |
|---|---|---|---|
| 3,010,143 | 11/1961 | Widmer | 16/327 |
| 3,474,487 | 10/1969 | Resag et al. | 16/349 |
| 3,584,333 | 6/1971 | Hakala | 16/341 |
| 3,837,040 | 9/1974 | Keller et al. | 16/333 |

*Primary Examiner*—Richard K. Seidel
*Assistant Examiner*—William Scott Andes
*Attorney, Agent, or Firm*—Harry G. Thibault; Richard P. Lange

[57] ABSTRACT

A tilt-lock mechanism for a pivotable panel assembly incorporates a pivotable locking link biased into locking engagement with a curved cam surface on the panel assembly to lock the assembly at a selected tilted position. A slight force applied opposite the bias of the link releases the link to return the panel to an initial position.

5 Claims, 2 Drawing Sheets

LOW PROFILE TILT LOCK MECHANISM WITH PIVOTABLE LOCKING LINK TO ENGAGE CAM SURFACE

The present invention pertains generally to positioning mechanisms and in particular to a tilt lock mechanism to instantly lock a panel in a selected position, such mechanism incorporating a quick release feature.

Generally a video recorder is packaged as a rectangular assembly with all of its control functions mounted on a front control panel of that assembly. However, that assembly should be convenient to use for any potential operator. Therefore it is desirable to tilt the front panel to a position that presents to any operator the most convenient access to the functional control mechanisms mounted on the front panel of the recorder. Moreover it is particularly desirable that the position selected by the operator can be steadfastly and constantly maintained.

Accordingly, it is desirable that the pivotably front control panel of the recorder incorporate a locking mechanism which permits the operator to rotate the panel to the selected one of an infinite variety of operating positions, instantly lock that panel in the selected position, and permit the operator to return the panel to its original locking position when he is finished or to any tilt angle less than the current angle of tilt.

Known prior art is not directed to a simple structure like that of the present invention. For example, in U.S. Pat. No. 3,584,333, a hinge for an automobile door incorporates an infinite position, hold-open detent but that detent incorporates a multiplicity of parts, many of the parts of complex shape and structure and the mechanism includes but a single release position. That is, the detent can only be fully disengaged by opening the door all the way. Moreover, that structure carries the locking element on its movable door, a significant structural difference from the mechanism of the present invention.

In a smaller environment, such as the video recorder control panel, it is desirable that the positioning mechanism be simple, employ a minimum of parts, those parts being of relatively simple construction, with the panel movable to an infinite number of positions and being instantly lockable at a selected position, and incorporating a quick release feature to instantly return the panel to its initial position or to any tilt angle less than the current angle of tilt.

Accordingly the present invention provides a pivotable control panel mounted on a video recorder, the control panel being the front panel of the recorder and carrying thereon a multiplicity of functional mechanisms. The control panel is carried on a first pivot pin mounted on a side plate of the video recorder, with a cam surface rigidly mounted on the front panel and disposed adjacent the side plate of the video recorder, a locking link mounted on a second pivot pin, said second pin displaced from the first pivot pin, the locking link having one end disposed adjacent the cam surface, to engage the cam surface as the contro panel is pivoted about the first pivot axis to lock the panel in a selected position, and including a quick-release mechanism operable to return the control panel to its initial position.

DETAILED DESCRIPTION

Figure 1:
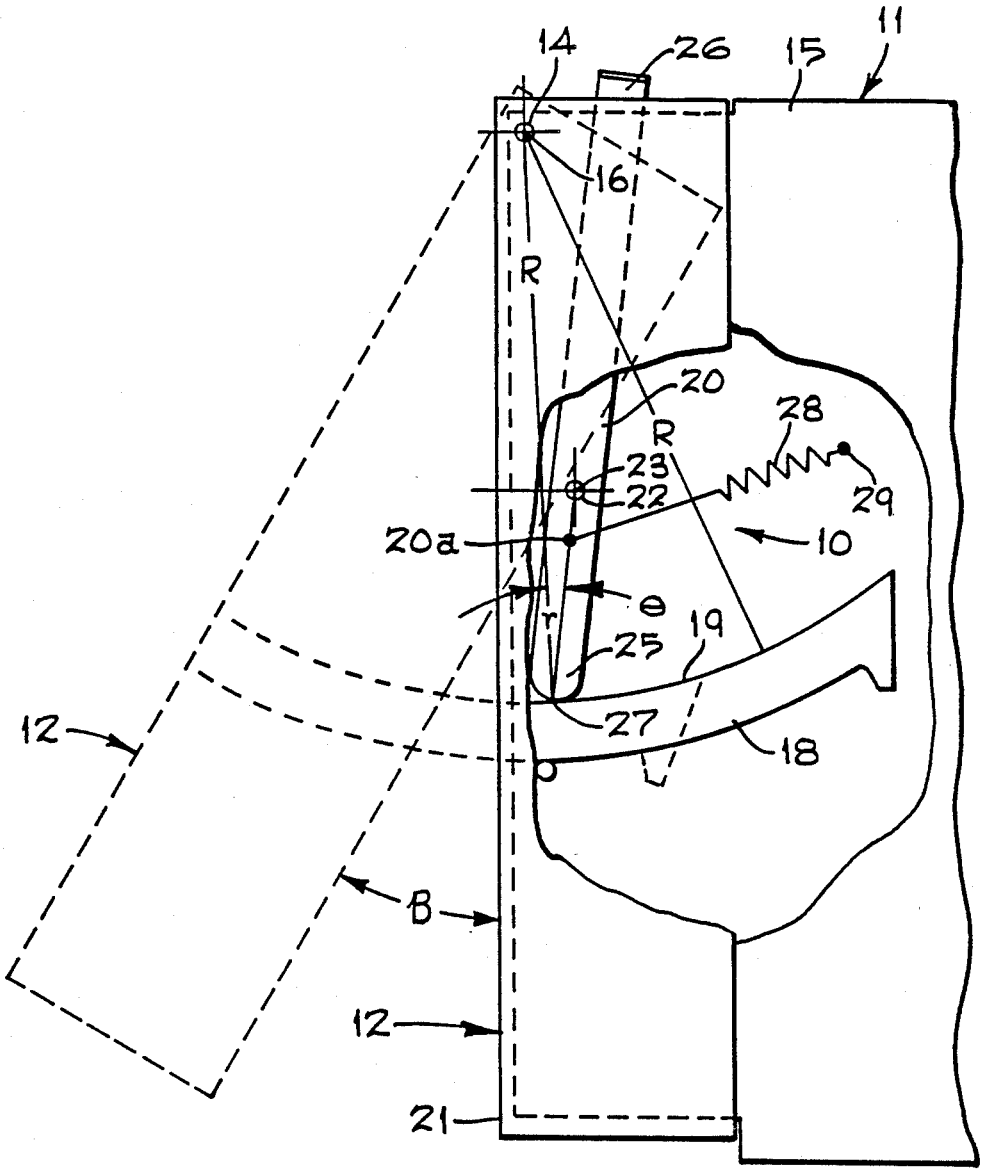
FIG. 1 is a schematic representation of the mechanism of the present invention.

FIG. 1 is a schematic representation of the tilt lock mechanism 10 of the present invention. In the configuration of the tilt lock mechanism 10 shown in FIG. 1, the control panel 12 of a video recorder 11 is mounted at a fixed pivot pin 14 defining a first pivot axis 16 and rigidly secured to a side plate 15 of the video recorder 11. The panel 12 pivots about the axis 16, which is generally perpendicular to the face of the side plate 15 of the recorder 11. Rigidly mounted on the control panel 12 is an elongated cam element 18, the cam element 18 having, at an upper face, a curved cam surface 19 disposed at a constant radius R from the pivot axis 16.

A locking link 20 mounted inwardly of a front vertical face 21 of the control panel 12, is mounted on a fixed pivot pin 22, secured to the side plate 15 and defining a second pivot axis 23 displaced from the axis 16 of the first pivot pin 14. Both the cam element 18 and the locking link 20 are disposed between the side plate 15 and a side plate 24 of the control panel 12. The locking link 20 is an elongated member having a first, generally arcuate end 25 mounted to engage with the cam surface 19 of the cam element 18 and an opposite end 26 extending above the top of the side plates 15 and 24 for engagement by the user of the control panel 12 for a reason to be described below. A biasing member, such as a spring 28, connects the link 20 to a point 29 on the side plate 15. The spring 28 is connected to the link 20 at a point **20*a*, the point 20*a* preferably disposed between the pivot axis 23 and the cam surface 19, to bias the locking end 25 of link 20 into locking engagement with the cam surface 19 of the cam element 18**.

The locking relationship between the link 20 and the cam surface 19 is achieved by the relationship between the radius R of the control panel cam surface 19, and an angle $\theta$ (thetal), the angle $\theta$ defined as the angle between two radii, the first being the radius R, between the axis of the first pivot pin 14 and the point of contact 27 of the locking link 20 with the cam surface 19, and a second radius r between the pivot axis 23 of the pivot pin 22 and the point of contact 27 of the locking link 20 with cam surface 19. The angle $\theta$ defined by the radii R and r at the point of contact 27 with cam surface 19 remains constant for a defined mechanism for any selected angular position of the panel 12. In FIG. 1 the angular position of the control panel 12 is defined by the angle $\theta$ (beta).

In operation, there is no movement of the locking link 20 about the pivot axis 23 as the panel 12 is moved toward a selected tilt position. However, a slight movement of the link 20 is required to disengage the arcuate end 25 of link 20 from the cam surface 19 to permit the control panel 12 to return to an initial, generally perpendicular position. Such return is achieved by applying a force opposite the force of the biasing spring 28, such as the application of force to the end 26, opposite the end 25, of link 20 to disengage the end 25 from the cam surface 19 and permit the control panel 12 to rotate about the pivot axis 14 to return to its initial position.

Figure 2:
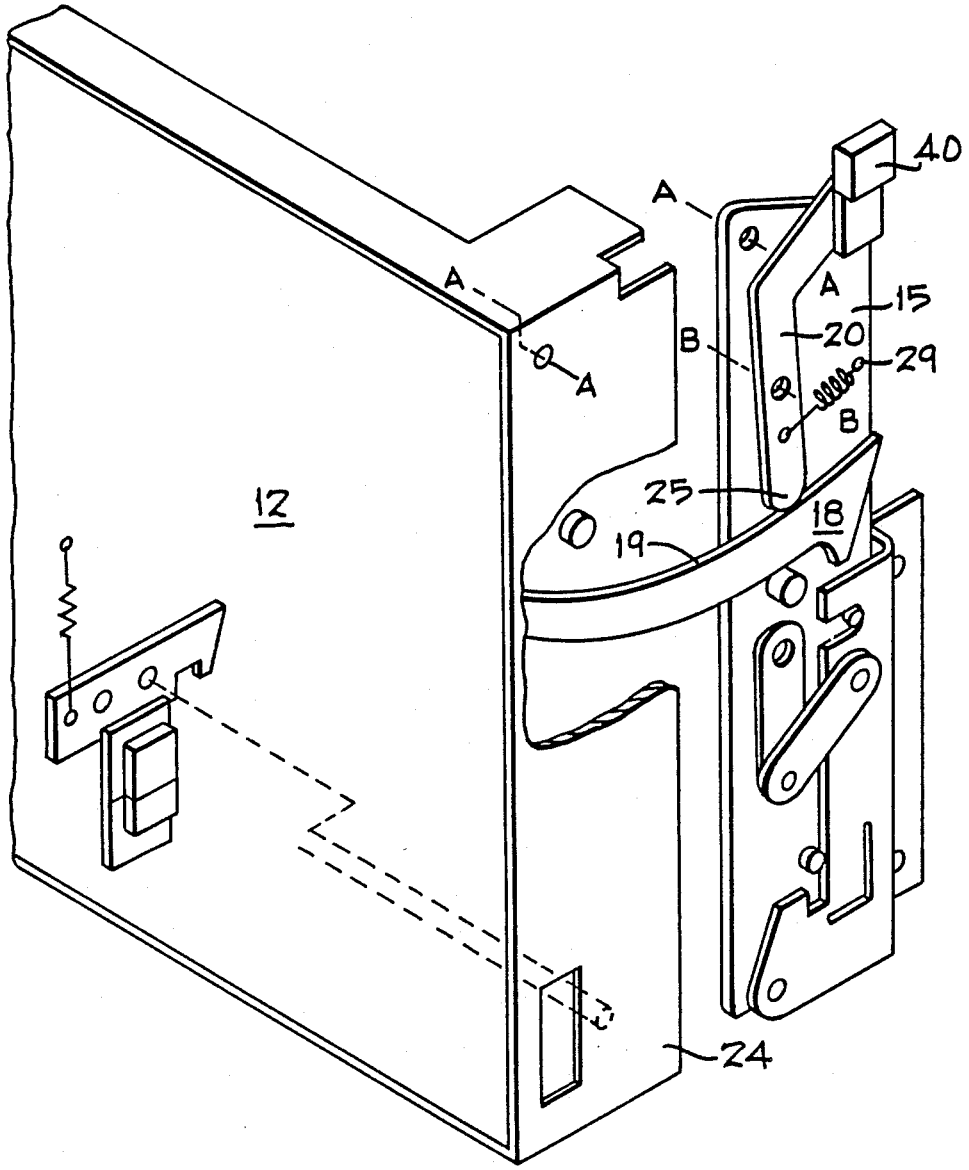
FIG. 2 is an exploded perspective view of implementation of tilt lock mechanism of the present invention in a video recorder.

A specific implementation of the tilt lock mechanism 10 of FIG. 1 is shown in FIG. 2 wherein the control panel 12 is mounted on a pivot axis A-A of the side plate 15 of the video recorder 11. Carried on the control panel 12 and rigidly mounted to the inside of inner side wall 24 thereof, is the cam element 18, the cam element 18 incorporating the elongated cam surface 19. Engaging the cam surface 19 is the locking link 20 having a locking end 25 disposed adjacent the cam surface 19. One end of a biasing member 28 is connected to the link 20 below the pivot axis B-B and at an opposite end is connected to a fixed point 29 on the side plate 15. Upper release 40 extends above the top of the control panel 12 to enable the user to disengage the locking end 25 of link 20 from the cam surface 19 to release the panel 12 from a selected position for return to its initial position.

The tilt lock mechanism of the present invention has been described in connection with the control panel 12 of a video recorder 11, the specific environment for which it was designed and therefore considered to be the "best mode" of the invention. However, it should be recognized that such a mechanism can have substantially wider use than the described preferred embodiment and such mechanism is not limited to the specific structure of the preferred embodiment. The appended claims are intended to set forth the breadth and scope of the invention described herein.

What is claimed is:

1. A tilt lock mechanism for a pivotable panel assembly comprising a base member and at least one panel element mounting on the base member for pivotable movement about an axis generally perpendicular to adjacent faces of the base member and the panel element, the tilt lock mechanism comprising:

the axis including a first pivot pin mounted on the base member to define a first pivot axis member;

the at least one panel element mounted on the base member for movement about the first pivot axis;

a cam surface rigidly mounted on the panel element and disposed for movement adjacent the base member;

a second pivot pin mounted on the base member and displaced from the first pin, the second pivot pin defining a second pivot axis;

a locking link mounted on the second pivot pin, the link having a first end portion disposed for engagement with the cam surface and a second portion exterior of the base member selectively moveable in a direction to release the locking link; and a biasing member connected between the locking link and the base member, to urge the locking link in a first direction and into engagement with the cam surface, to lock the panel assembly in a selected position, the biasing member being movable in an opposite direction to release the locking link from engagement with the cam surface and permit the panel assembly to freely move about the first pivot axis.

2. A tilt lock mechanism as claimed in claim 1 wherein the biasing member comprises a tension spring having a first end mounted on the locking link and disposed between the second pivot axis and the end portion of the link engaging the cam surface.

3. A tilt lock mechanism as claimed in claim 2 wherein the locking link includes a second end portion, opposite the end portion engaging the cam surface, the second end portion providing a handle movable in a direction against the bias of the spring to release the locking link.

4. A tilt lock mechanism for a pivotable panel assembly comprising a base member and at least one panel element mounted on the base member for pivotable movement about an axis generally perpendicular to adjacent faces of the base member and the panel element, the tilt lock mechanism comprising:

the axis including a first pivot support member mounted on the base member to provide a first pivot axis generally perpendicular to the base member, the at least one panel element mounted on the first pivot support member;

a panel assembly cam surface rigidly mounted on the at least one panel element and disposed for movement adjacent the base member;

a second pivot support member mounted on the base member and displaced from the first member to provide a second pivot axis generally perpendicular to the base member;

a locking link mounted on the second pivot support member, the link having opposite ends, a first end disposed for engagement with the cam surface of the panel assembly and a second portion exterior of the base member selectively moveable in a direction to release the locking link; and a biasing member connected between the locking link and the base member, to urge the first end of the locking link in a first direction into the engagement with the cam surface, to lock the panel assembly in a selected position, the member movable in an opposite direction to release the locking link from engagement with the cam surface and permit the panel assembly to freely move about the first pivot axis.

5. A method for tilting and locking a pivotable panel assembly comprising a base member and at least one panel element mounted on the base member for pivotable movement about an axis generally perpendicular to adjacent faces of the base member and the panel element, at a selected, tilted position, the tilt-lock method comprising:

defining a first pivot axis on the base member;

mounting the panel element on the base member for movement about the first pivot axis;

rigidly mounting a cam surface on the panel element for movement adjacent the base member;

defining a second pivot axis on the base member displaced from the first pivot axis;

mounting a locking link on the base member for movement about the second pivot axis, said link having a first end portion disposed for engagement with the cam surface and a second portion exterior of the base member selectively moveable in a direction to release the locking link;

connecting a biasing member between the locking link and the base member, to urge the locking link in a first direction and into engagement with the cam surface, to lock the panel assembly in a selected position, the biasing member movable in an opposite direction to release the locking link from engagement with the cam surface and permit the panel assembly to freely move about the first pivot axis.

* * * * *